US011006681B1

(12) United States Patent
Campos

(10) Patent No.: US 11,006,681 B1
(45) Date of Patent: May 18, 2021

(54) VISOR APPARATUS

(71) Applicant: Luis Campos, Little Rock, AR (US)

(72) Inventor: Luis Campos, Little Rock, AR (US)

( * ) Notice: Subject to any disclaimer, the term of this patent is extended or adjusted under 35 U.S.C. 154(b) by 404 days.

(21) Appl. No.: 15/729,647

(22) Filed: Oct. 10, 2017

Related U.S. Application Data

(63) Continuation-in-part of application No. 14/611,750, filed on Feb. 15, 2015, now abandoned.

(51) Int. Cl.
*A41D 13/11* (2006.01)

(52) U.S. Cl.
CPC ..... *A41D 13/1184* (2013.01); *A41D 13/1153* (2013.01); *A41D 2200/20* (2013.01)

(58) Field of Classification Search
CPC ..... A41D 13/1184; A41D 13/1153; A41D 2200/20; A42B 1/201; A42B 1/20; A42B 3/32; A42B 3/226; A42B 3/18; A42B 3/20; A42B 3/22; A42B 1/206
See application file for complete search history.

(56) References Cited

U.S. PATENT DOCUMENTS 1,803,538 A * 5/1931 Pistole ..... A45B 11/02 224/187
2,344,811 A 3/1944 Gill
3,568,211 A * 3/1971 Petruzella, Jr. ..... A42B 3/226 2/410
4,291,417 A * 9/1981 Pagano ..... A42B 1/201 2/202
5,105,475 A * 4/1992 Lynd ..... A42B 3/185 2/10
5,113,535 A 5/1992 Hedges et al.
5,544,361 A 8/1996 Fine
5,896,590 A * 4/1999 Fleisch ..... A42B 3/322 2/410
6,460,198 B1 * 10/2002 Dilworth, Jr. ..... A41D 13/1209 2/246
7,725,949 B2 * 6/2010 Landis ..... A61F 9/022 2/206
2003/0143795 A1 * 7/2003 Guo ..... H03K 17/04106 438/200
2015/0089711 A1 * 4/2015 Gibson, Jr. ..... A42B 1/048 2/84
2016/0219961 A1 * 8/2016 Campos ..... A41D 13/1153

* cited by examiner

*Primary Examiner* — Alissa J Tompkins
*Assistant Examiner* — Brieanna Szafran
(74) *Attorney, Agent, or Firm* — Rashauna Norment

(57) ABSTRACT

A visor apparatus has a double layered frame that is attachable to the existing head covering (hoodie) of an article of clothing. The apparatus further has two visor members, a cushion, a plurality of connector members, and a locking mechanism. The visor members are pivotably extendable from within frame's double layer to cover a user's face and neck. One or both visor members may be selectively adjusted for use as a covering or as a face shield. The frame provides stability and structure to the fabric material of the clothing.

20 Claims, 10 Drawing Sheets

VISOR APPARATUS

DETAILED DESCRIPTION OF THE INVENTION

The present invention, preferred embodiments of the invention, and the accompanying drawing figures as described herein should not be construed as limited to the illustrated drawing. Rather the illustrated embodiment(s) are detailed to provide a thorough disclosure suitable to convey the scope of the invention to those skilled in the art. For the sake of simplicity, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

Figure 1:
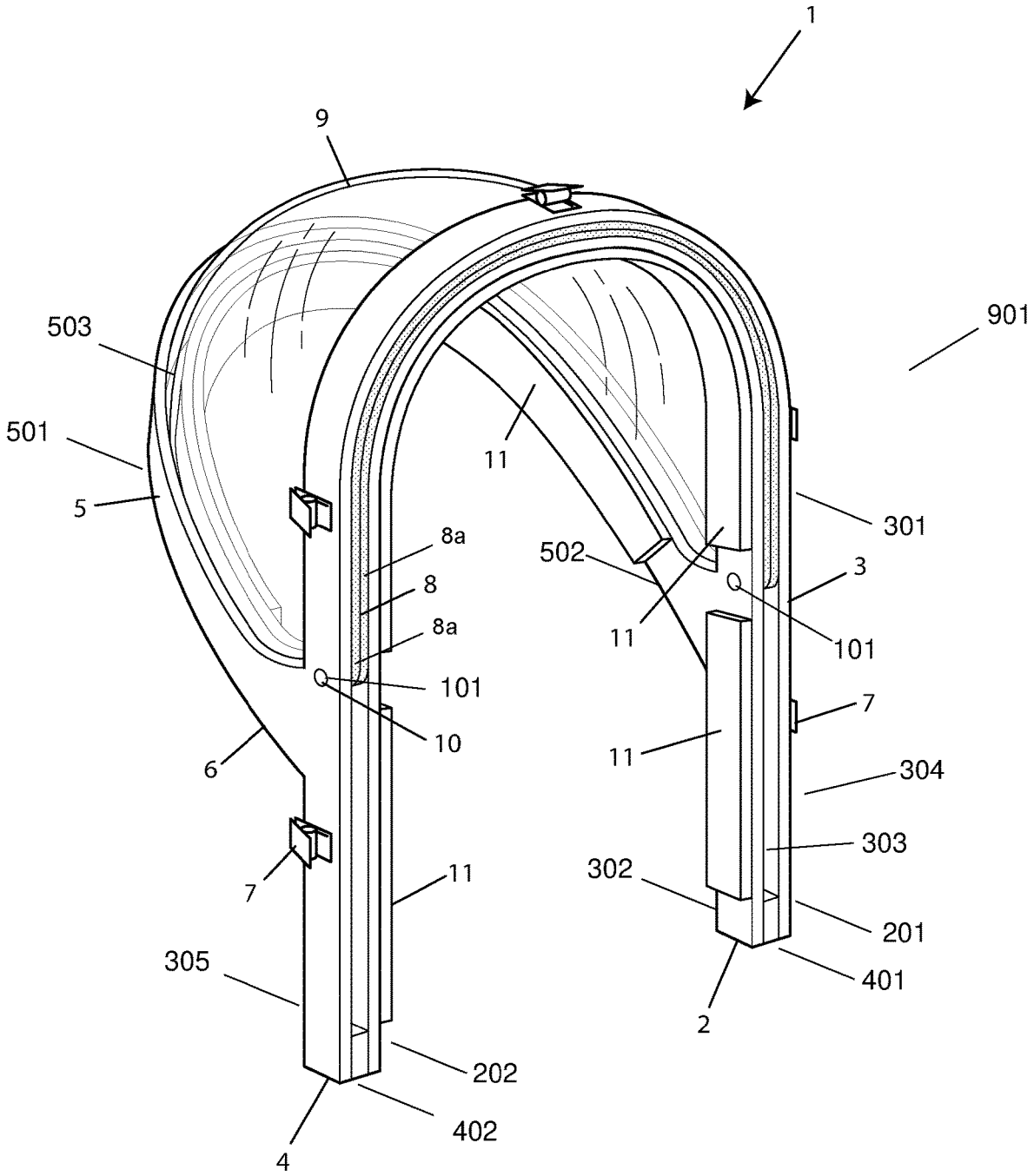
Figure 3:
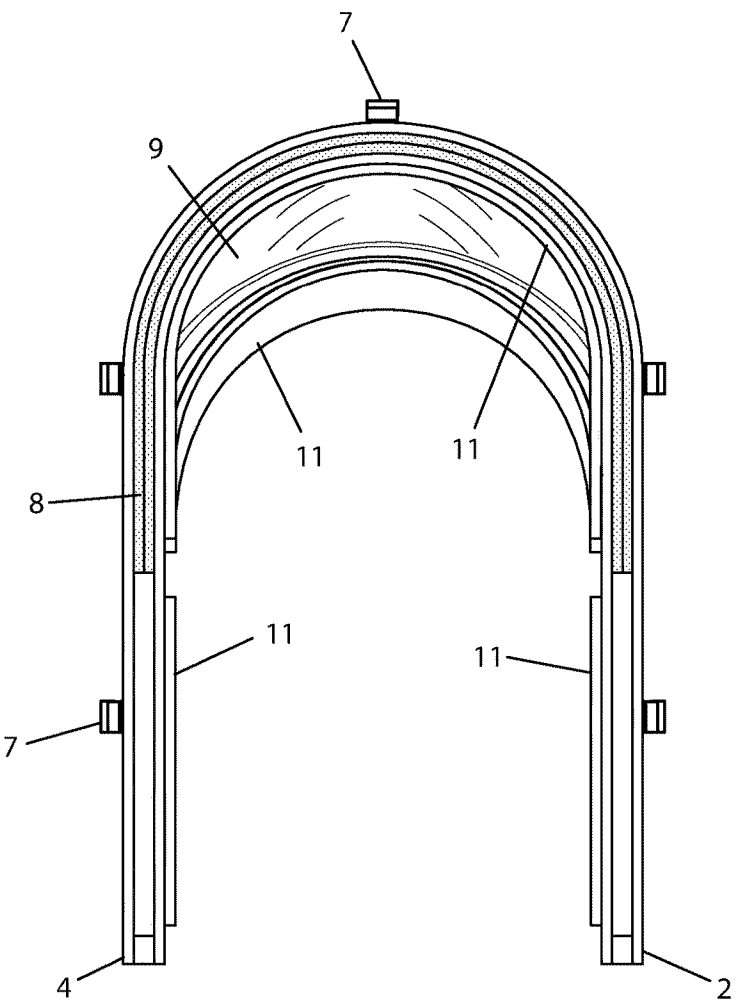
Figure 4:
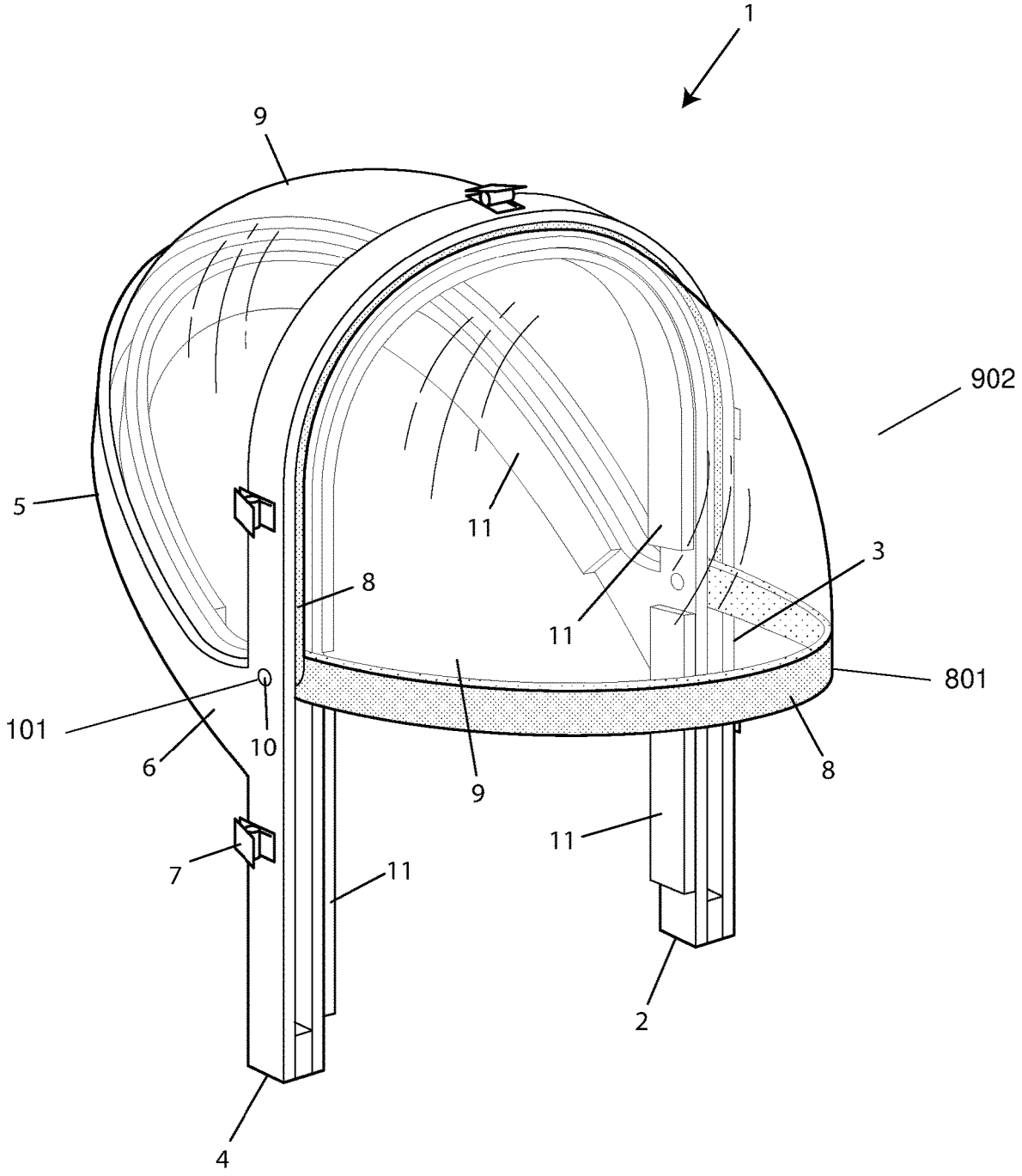
Figure 6:
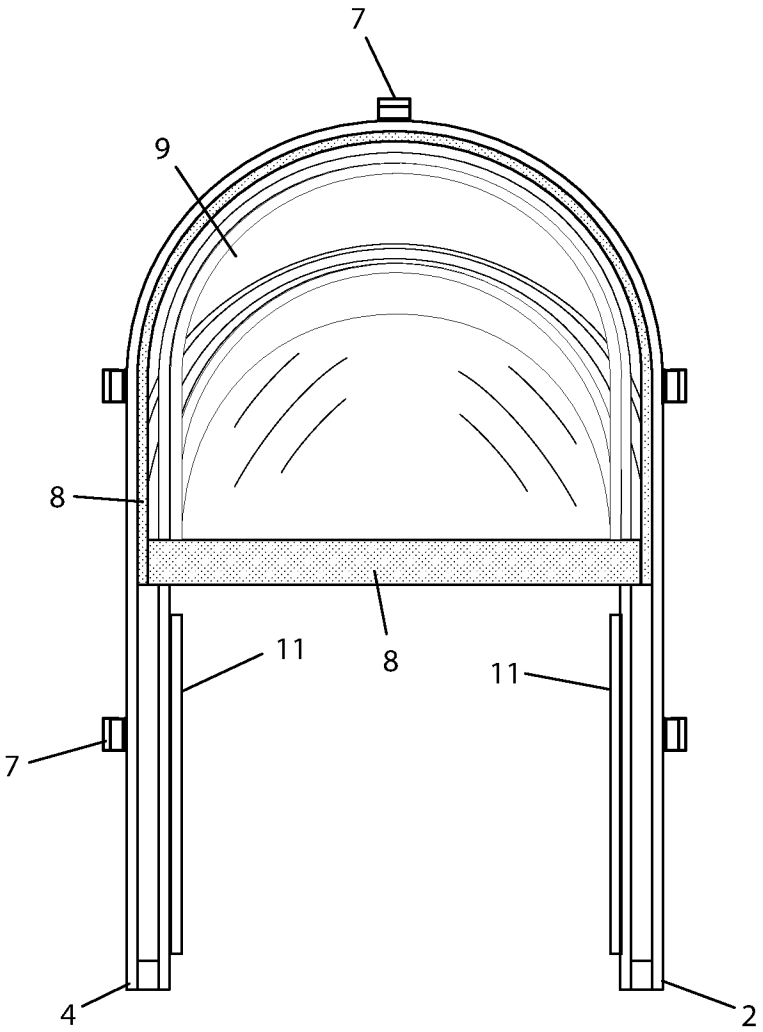
Figure 5:
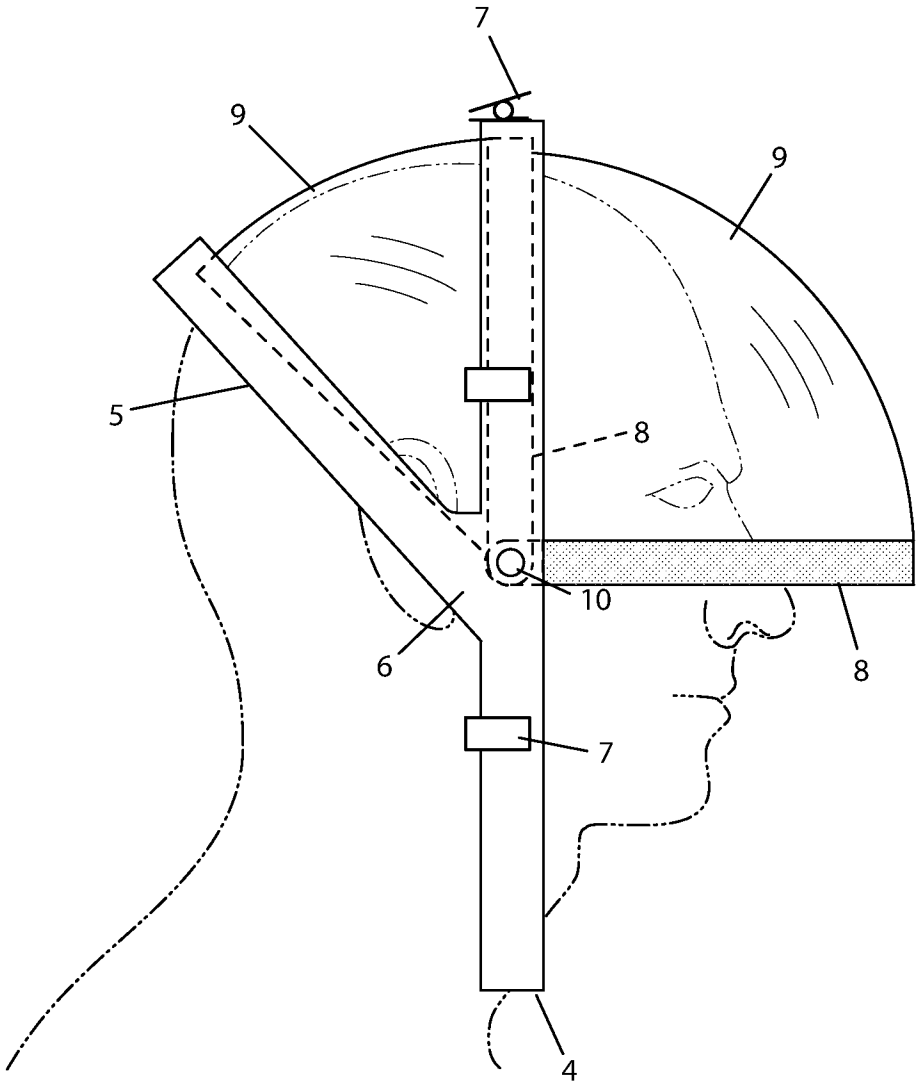
Figure 7:
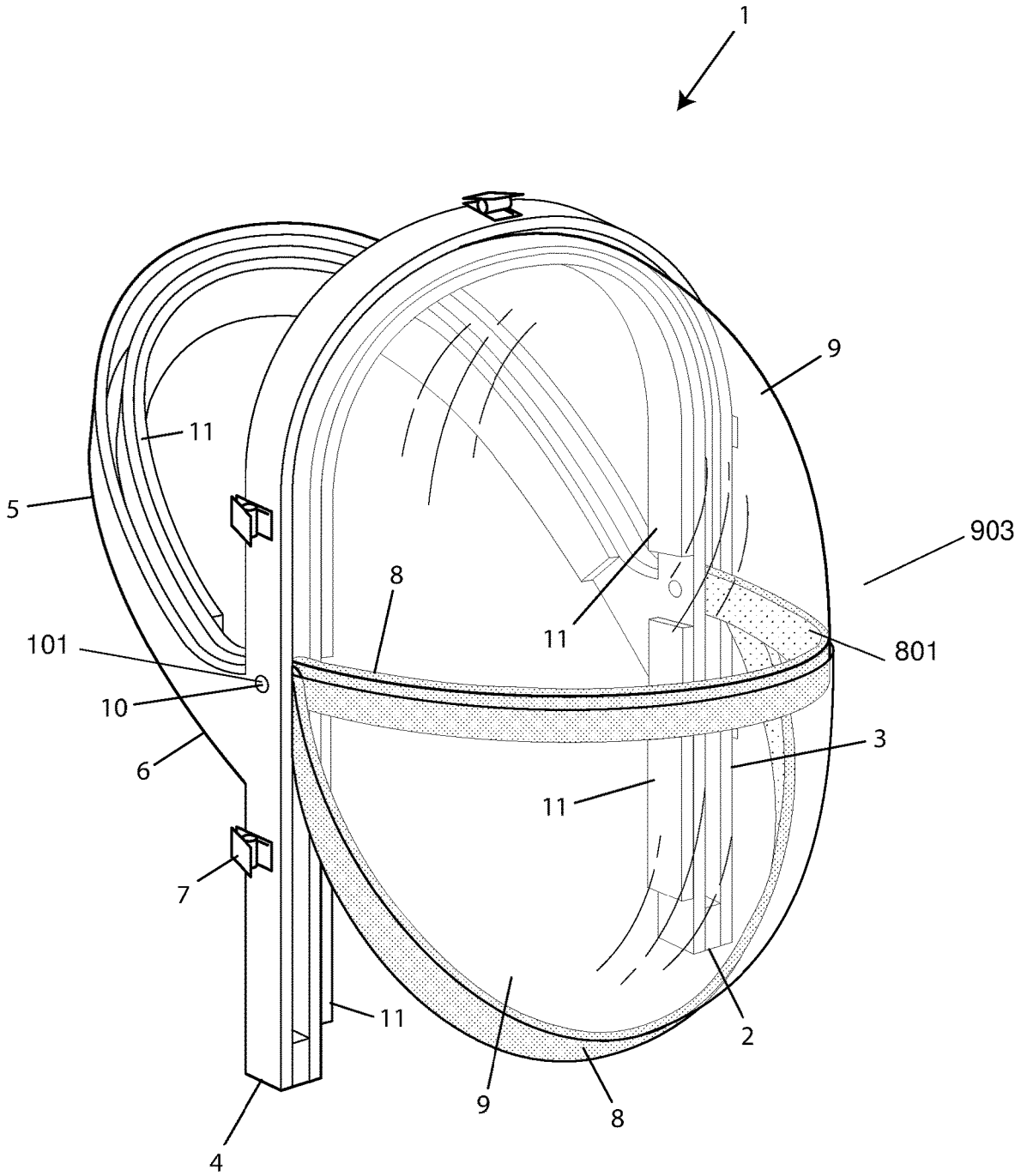
Figure 9:
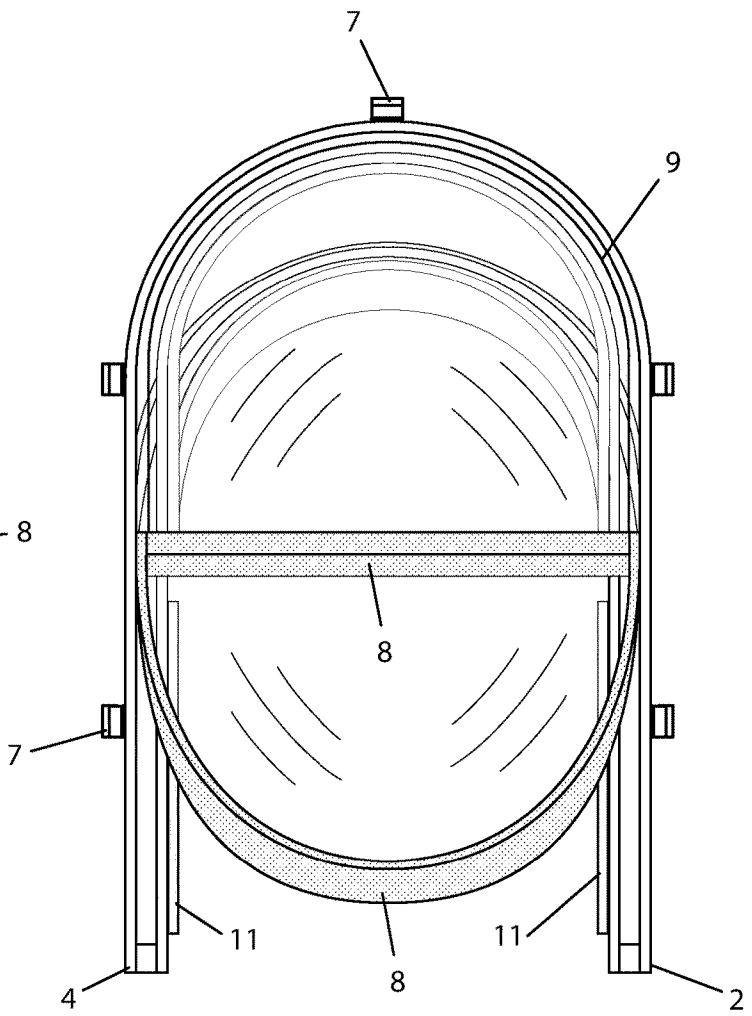
Figure 8:
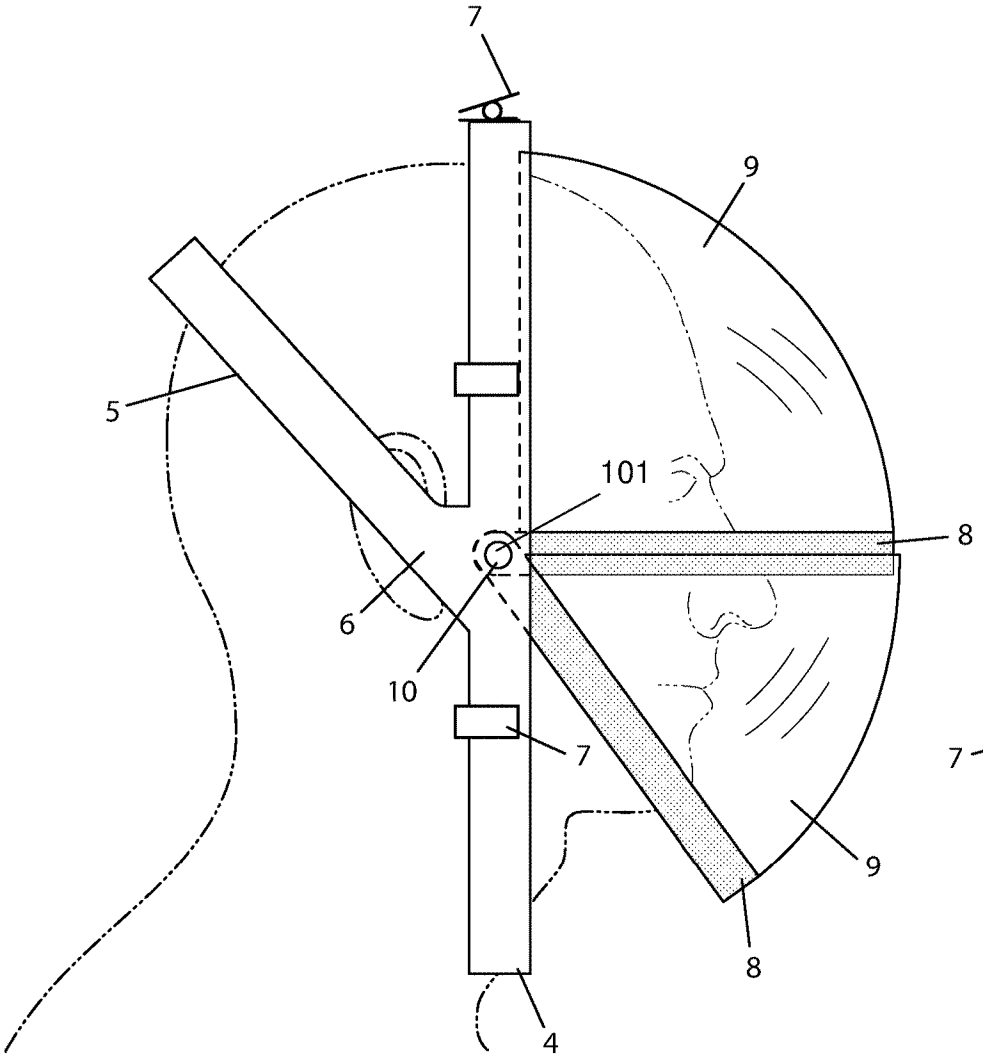

As shown in FIGS. 1-15, an embodiment of the invention is a visor apparatus 1 comprising (including or having) a frame 2, at least two visor members 8, a locking mechanism 10, a cushion 11, and a plurality of connector members 7; wherein the frame 2 comprises a support member 3, two stop members 4, 401, 402, a brace member 5, and a bridge 6; wherein the support member 3 has a first, upper layer 301 spaced apart from a second, lower layer 302 forming a first gap 303, with one of each of the stop members 4 being mounted between the two support member layers at each respective end of the support member 201, 202; wherein the bridge 6 joins the support member 3 and the brace member 5; wherein the brace member 5 has a first, upper layer 501 spaced apart from a second, lower layer 502 forming a second gap 503; wherein each of the plurality of connector members 7 is removably connectable to the clothing hoodie; and wherein the two visor members 8 each selectively travel about an arc point, with the visor members 8 position being lockable with the locking mechanism 10. The visor members 8 selectively move from a retracted position to one or more expanded positions, as shown in FIG. 1 (both retracted, Point A, 901), FIG. 4 (one visor in expanded position, Point B, 903), and FIG. 7 (second visor in expanded position, Point C, 903).

The visor apparatus is a portable, lightweight, and reusable multi-purpose tool for keeping the user's face and neck shielded and protected from rain, wind, snow, sand, UV rays from the sun, and any other environmental and weather conditions (collectively, "environmental conditions"). The visor apparatus may be provided in different sizes, while maintaining the required portions for functionality, stability, and structure. The visor apparatus may be easily cleaned without disassembling any of the apparatus' components.

The frame 2 of the apparatus 1 is preferably made from at least a semi-rigid to substantially rigid material including, but limited to, plastic or plastic-like material, preferably, fiberglass. The frame should have a slight give or bend to the structure to allow for minor adjustments and user movement when the apparatus is worn. The frame is lightweight and is easy to use and wear. When worn, the support member is positioned toward the top, central portion of the user's head, and extends downwardly by the user's cheeks and jaw line. The brace member is positioned behind the crown of the user's head. The bridge is positioned near the user's ears.

The frame has essentially a dual or doubled layered surface spaced apart by a gap along the frame's perimeter. In the embodiment as shown in the figures, each layer of the support member 3, the brace member 5, and the bridge 6 is formed from a single piece of material rather than being individual components that are mounted together.

The support member 3 of the frame 2 is preferably configured as an inverted substantially U-shaped or arcuate support member that is placed over the top central portion of the user's head, as shown in FIGS. 2, 5, 8, 11, and 14. The U-shaped support member has a horizontal bar, two arms 304, 305, and two stop members 4. An inverted, contoured U-shaped support member is preferred so that the flexible, bendable fabric of the hoodie can adapt and drape easily over the support member. Alternatively, the support member may have less contouring where the ends of the bar meet the proximal, upper portion of the arms.

The entire support member 3 has a dual or double layered surface. More particularly, the support member 3 has a first, upper layer (or surface) and a second, lower layer (or surface). The upper and lower surfaces are separated by a gap or spacing extending therethrough. The gap between the support member layers should be wide enough to snugly receive the two visor members 8 when the visor members 8 are both in the retracted position. A seal may also be used between the inner layers to prevent, or at least to decease, environmental conditions from seeping passed the support member gap when the two visor members are in one or more of the expanded positions over the user's face.

Each arm of the inverted U-shaped support member abuts, or otherwise extends downwardly from, an end of the horizontal bar. The location of the inverted U-shape of the support member where the horizontal bar meets the two opposing downwardly extending arms, is preferably arcuate or contoured. Each arm further defines a bore 101 therethrough so that each arm can engage with both the locking mechanism 10 and the respective side of the visor member at the arc point 10. The arms are also used as handgrips by the user to grasp when installing, adjusting, or removing the apparatus. Using a substantially square, rectangular, or jointed connection of the bar to the arms is not preferred because such configuration would require that the shape of the visor members also be changed. Changing the visor members shape would impair the pivotable movement of the visor members. The U-shape support member helps adapt and drape the hoodie to frame to keep the hoodie of the clothing from collapsing.

The length of the downwardly extending arms of the support member should extend below the average length of the chin of the user. In another embodiment (not shown), the length of the support member arms is adjustable upwardly or downwardly depending on the user's personal requirements. Here, each of the support member arms further has a telescopically extendable section of the arm, at least one detent, and at least one aperture. The detent and the aperture cooperate together as locking points or adjustment points as the length of support member arms is adjusted. In yet another embodiment, the lower section support member arms near the stop members allow for slight outward flaring if the user moves his head downwardly.

As shown in the figures, each stop member is sandwiched between the layers of the support member arms, thus forming the gap between the support member layers. The stop members are preferably located at the distal end portion of the arms. The stop members 4 also act as a lower barrier to the visor members 8 downward movement.

Figure 2:
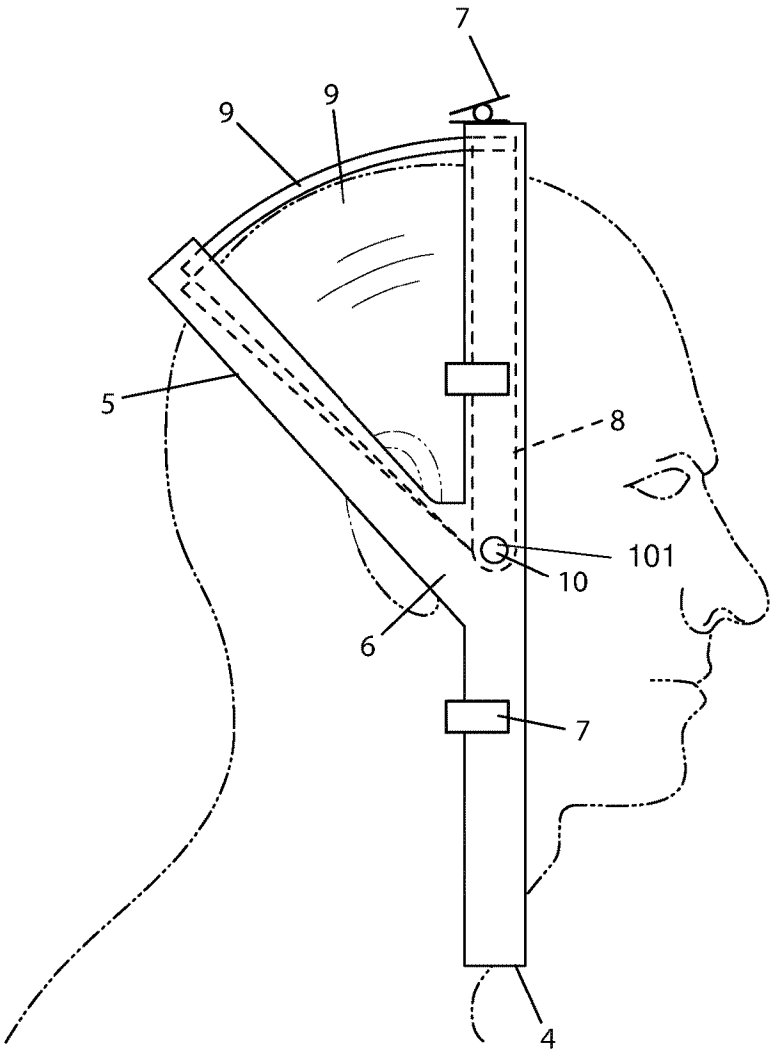

The brace member 5 of the frame 2 is a double or dual layered arcuate or domed brace. The brace member 5 extends behind the support member 3 to steady the apparatus 1 at the back of the user's head. Preferably, the brace member extends rearwardly and upwardly approximately midway from the support member arms. Preferably, there is an opening between the back of the edge of the support member bar and the front or forward edge of the brace member. The brace member is essentially two arcuate brace layers (or surfaces), with each brace layer being affixed to, or otherwise formed from, the respective layer of the support member arms. Therefore, a first, upper brace layer is affixed to, or is otherwise formed or extends from, the first upper support member arm layer. A second, lower brace layer is affixed to, or is otherwise formed or extends from, the second, lower support member arm layer. The hoodie is draped over the first outer brace layer during installation. When in a retracted position, both visor members may extend beyond the rear edge of the brace member, as shown in FIGS. 1 and 2.

In one embodiment, the ends of the brace member 5 may be joined to the support member 3 arms at a bridge 6. The bridge 6 may have a wider surface area to support the weight of the frame 2, the locking mechanism 10, and the visor member 8 connection points. As seen in FIG. 1, the bridge is also a double layered configuration separated by a gap to receive the visor members.

In a preferred embodiment, each layer of the frame components is made from a single piece of fiberglass formed into the desired shape of the frame. The support member 3 of the frame 2 does not touch the user's head due to the placement of the cushion between the user's head and the bottom of the support member 3.

Figure 10:
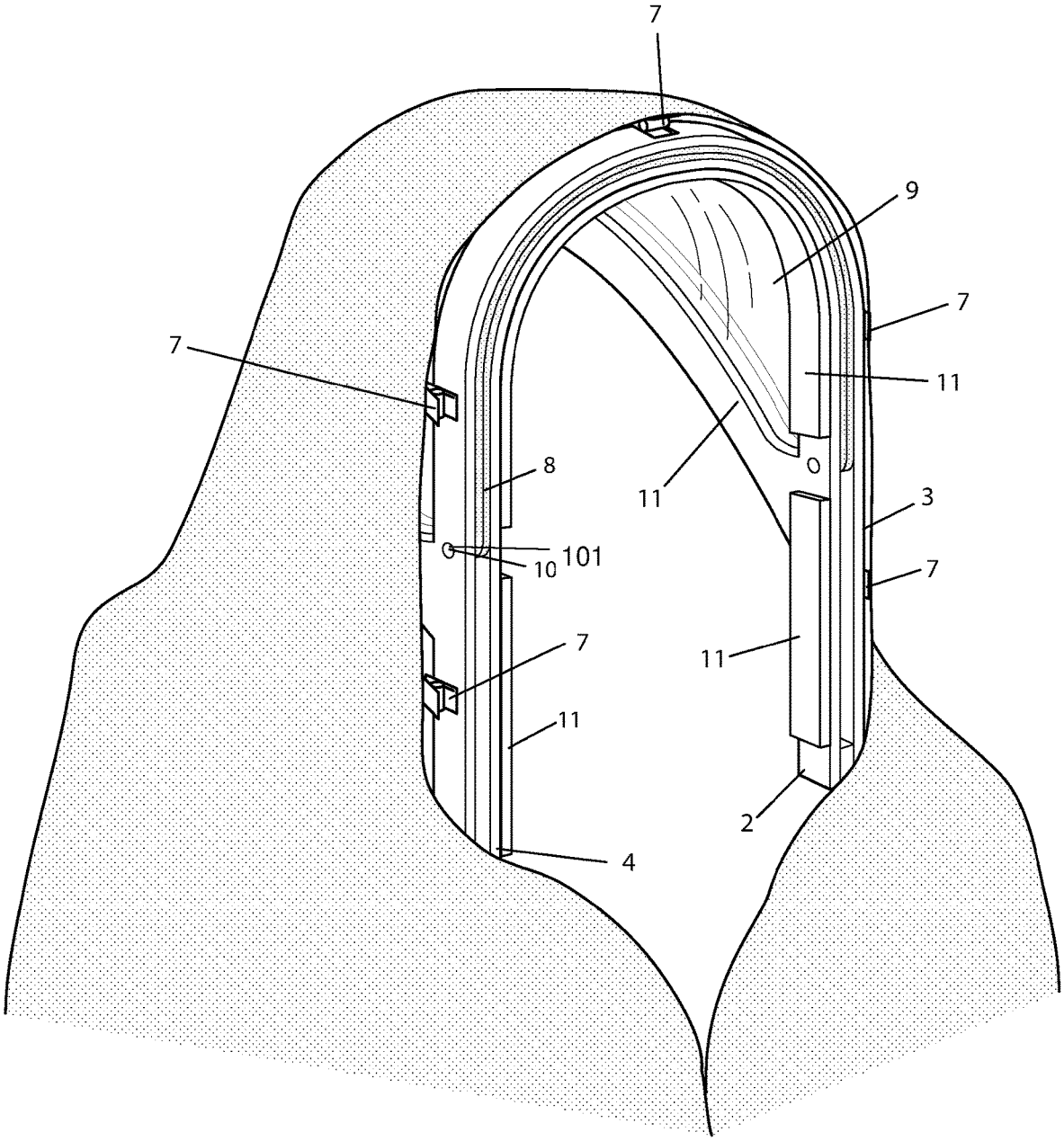
Figure 12:
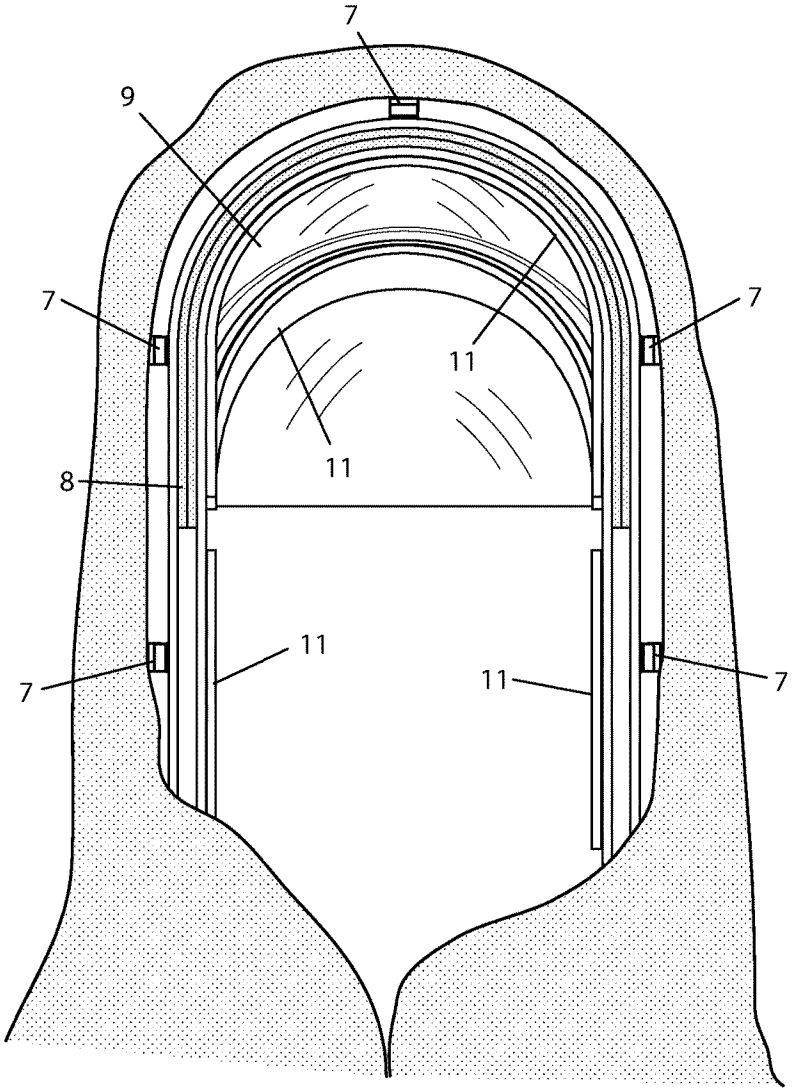
Figure 11:
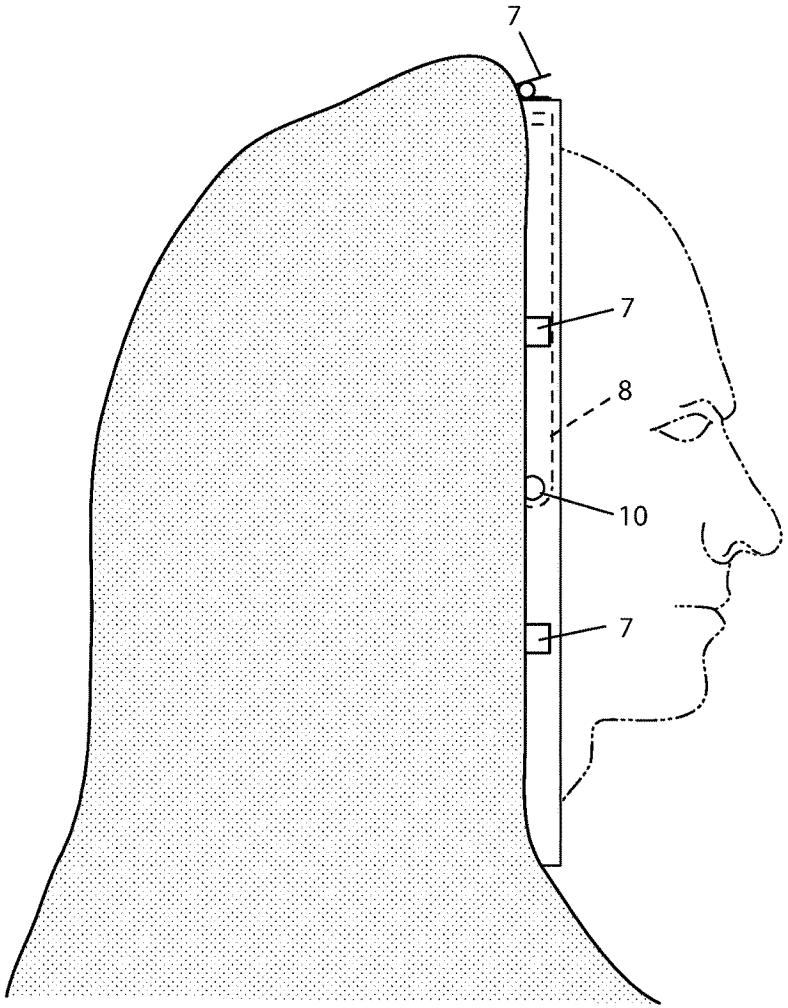

The frame is removably attachable to clothing hoodie by draping the hoodie over the frame and securing the hoodie to the support member with the plurality of connector members 7. Each of the plurality of connector members 7 are preferably selected from the group consisting of clips, snaps, pins, and combinations thereof, with at least one portion of the connector members being affixed to the exterior of the support member. The connector members may be magnetic or non-magnetic connector members. Other types of connector members are contemplated so as long as the hoodie clothing is not permanently altered or damaged. Each of the connector members removably connects the support member to the clothing hoodie without damaging the clothing. As shown in FIGS. 1 and 10, the connector members 7 are located along the length of the support member 3 for optimal structural support to aid in distributing the weight and pull of the hoodie fabric once the fabric is stretched over (or otherwise draped over) the frame. The connector members 7 do not interfere with the movement of the visor members 8 because each visor member 8 travels within the support member gap or opening.

As shown in FIG. 1, the cushion 11 is affixed underneath the support member 3 and the brace member 5 and separates the support member 3 from the user's head. The cushion may be made from padding material, foam, or combinations thereof. The cushion adapts to the shape of the frame. The support member may be gently pressed inwardly toward the user's head for a more snug fit. When installed, the frame, as suspended by the cushion 11, rests against the user's head. The frame remains in place on the user's head due to the connection to the hoodie and due to the position of the frame on the head.

When worn with both visor members in the expanded positions (Point B), wind and other environmental conditions cannot get inside the hoodie due to the placement and structure of the apparatus. The hoodie is attached to the exterior (or outer) part of the frame's upper layer. The seal of the double layer of the frame aids in preventing environmental conditions from entering the apparatus or the hoodie when each visor member is extended over the user's face and neck. The double layer of the frame also provides guidance for the visor members path about the arc point. The frame's structure, along with its arrangement and position of the other components, is distinguishable from existing visors and mosquito nets because this apparatus cooperates with the clothing hoodie and is structurally adapted for contouring a user's face for shielding the user's face against weather conditions, particularly, the wind.

The apparatus has at least two visor members 8 that are supported within the frame's double layers. Two visor members are preferred. A single visor member is discouraged because a single visor member would be too large and cumbersome to cover the face in the expanded position, and would be too large for storing the visor member in the retracted position within the frame. Also, a single visor member would not sufficiently cover the user's face.

Using at least two visor members allows the visor members to be essentially stacked on top of each other when in the retracted position. Each of the visor members 8 has a lens 9 (or screen), a rim 8 to support the lens 9, and a ventilation means 801. The two opposing ends (or sides) of the visor member 8 are pivotably coupled to the respective support member bores 101 and are securable with the locking mechanism 10. When in an open, retracted position (FIGS. 1-3), the visor members 8 are each positioned within the sandwich of the frame's 2 support member 3 and the brace member 5. The rim of the visor members 8 may be secured to the top of the support member 3 with a fastener or other connector member (not shown). When expanded into the full open position (FIGS. 13-15), the visor members overlap to keep rain and other weather conditions from running down onto the user's face.

In a preferred embodiment, the first upper visor member 8 is extendable from Point A, 901 the forward edge of the support member downwardly to the user's nose to Point B, 902, and the second lower visor member 8 is extendable from the lower portion of the first visor member 8 of Point B, 902 downwardly toward the user's neck to Point C, 903. As shown in FIGS. 1-2, 4-5, and 7-8, 11, and 13-14, each visor member is capable of incremental movement as the visor members travel from within the frame in a retracted position and along the arc point to shield the user's face in various expanded positions. When both visor members are in the expanded position, the lower portion of the first visor member overlaps the upper portion of the second visor. The two visor member positions may be interchangeable.

The visor members may be made from material that is sturdy, lightweight, weather resistant, and scratch and tear resistant. The visor member lenses are preferably made from a rigid, sturdy material rather than a flexible material such as mosquito netting or film. The rigidity of the lenses is preferred. The visor member lenses are essentially contoured or arcuate to cover the user's face and neck. The visor member lenses may further include at least one layer of protection against penetration of UV rays. The visor member lenses may further utilize transitional lens technology or made from a photochromic material, and/or be polarized.

Figure 13:
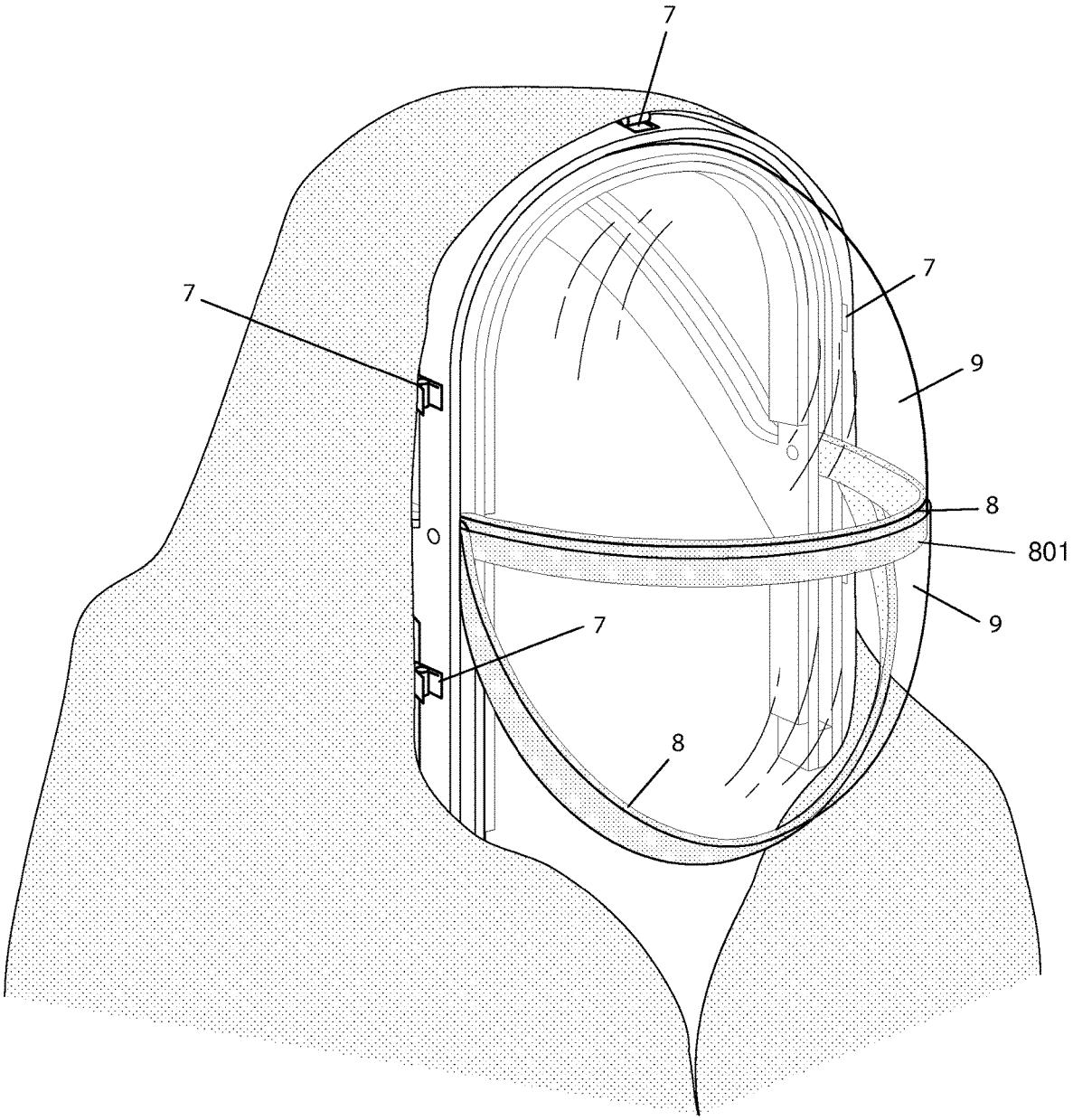
Figure 15:
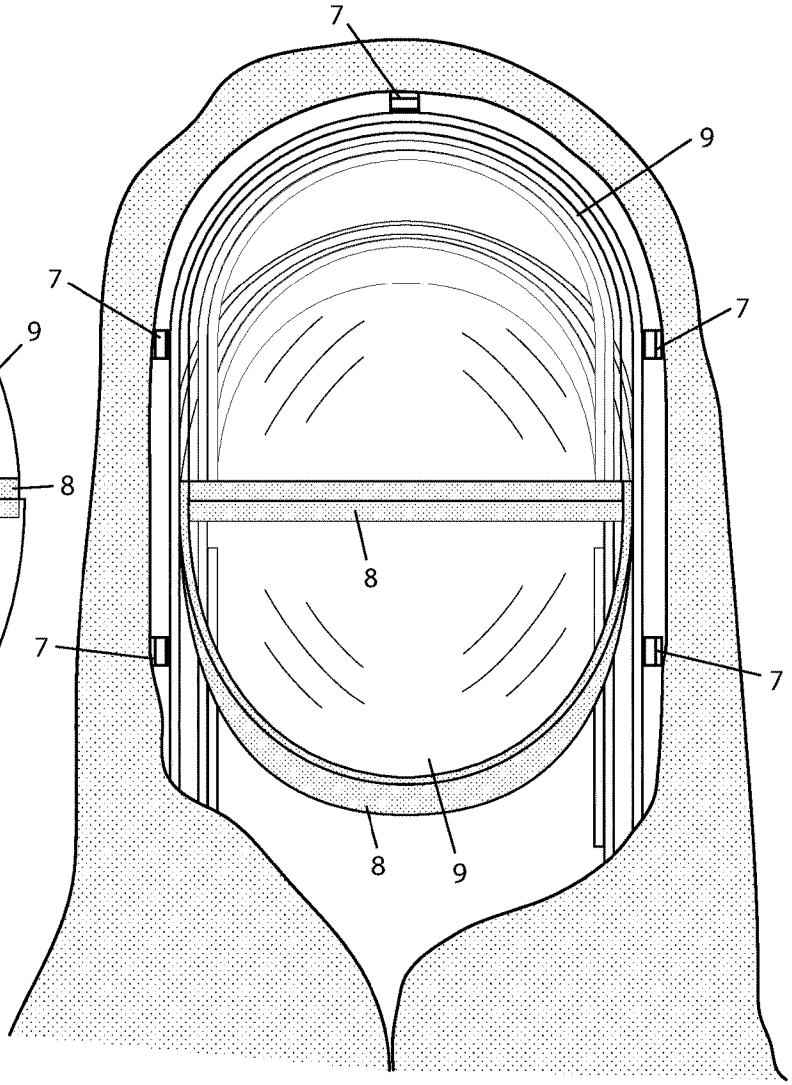
Figure 14:
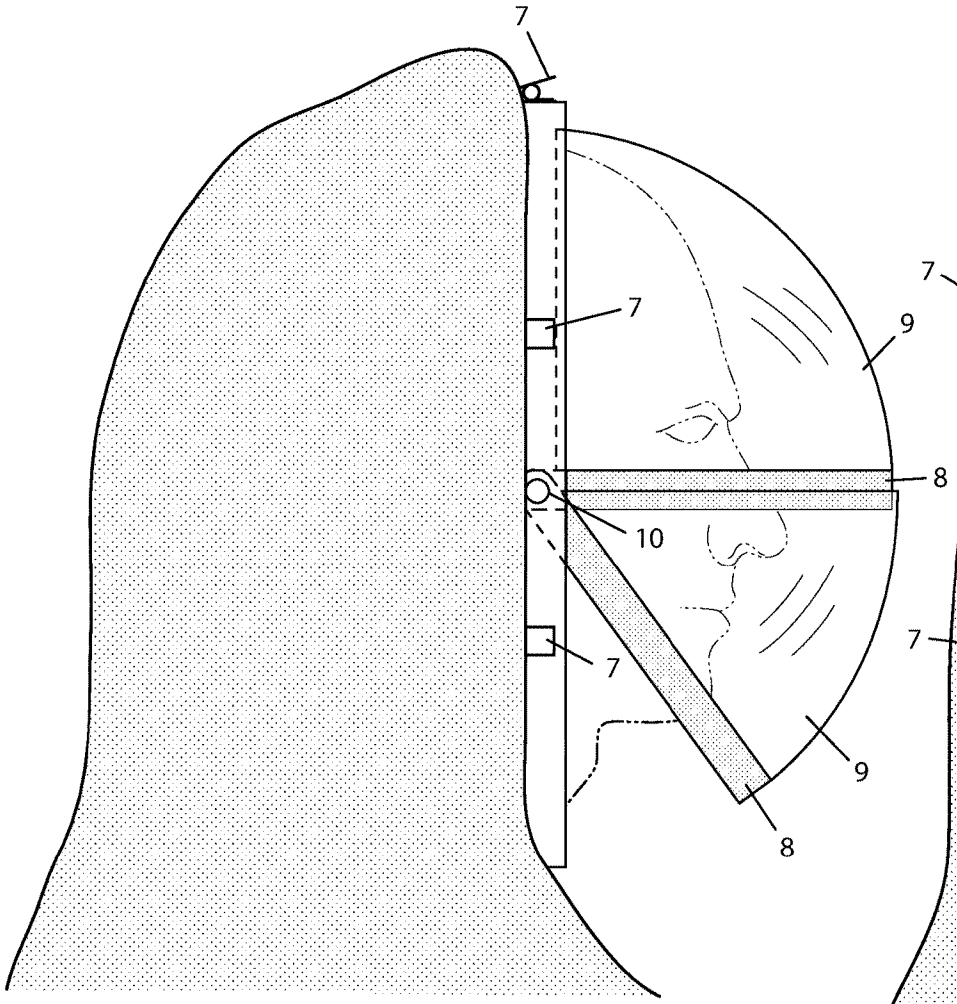

Each visor member further defines a plurality of ventilation holes or is otherwise made from a breathable material for adequate air circulation for the user when both visor members are in the expanded position. In the embodiment with the visor members having a plurality of ventilation holes, the ventilation holes are located around the perimeter of the rim of each of the visor members, as shown in FIG. 13. In another embodiment (not shown), the visor members each further include a closing member for selectively closing one or more of the ventilation holes, preferably at the top and sides of the visor member to prevent rain from reaching the user. The closing member may be a slider plate that slidably covers one or more of the ventilation holes.

In another embodiment (not shown), particularly for runners or those with excessive or jolting-type movements, a rear member of the frame is provided behind the brace member to form a full head covering of the apparatus. The cushion may also further extend along the entire frame to prevent the frame from bouncing or bumping against the user's head during strenuous activities. In yet another embodiment (not shown), additional connector members may be affixed along the exterior (or outer) length of the brace member to attach to the hoodie to further prevent the frame from moving during activities.

The locking mechanism 10 is essentially a rotatable gear member with locking points about which the visor members move. Each of the visor members bores is coupled to and engageable with the gear of the locking mechanism. The locking points (not shown) allow the user to selectively adjust and lock the position of each of the visor members along the arc of movement. The locking mechanism 10 is located on each side of the support member 3, preferably near the proximal end of the bridge 6 where the bridge 6 attaches to (or extends from) the support member 3. To selectively lock the desired expanded position of each visor member, the user pulls the respective visor member downwardly to the desired position until the gear locks or clicks into place. To unlock each visor member to retract the visor member upwardly toward or into the support member gap, the user first pushes the visor member with enough force to overcome the locking point, then pushes the visor member upwardly to the desired position. As an example, if the user wanted to only lower the first visor member over his eyes, he would unsnap or disengage the rim of the first visor member from the top of the support member, then pull down the first visor member to the desired position until the visor member clicked and locked into position. The second visor member could stay secured within the frame. To remove the apparatus from the hoodie, the user disconnects each of the connector members from the hoodie, then removes the frame from the hoodie and the person's head.

The shape of the frame and the cushion adds height and support to the hoodie so the visor members can be pushed into the frame to avoid detection of the visor members from the front of the apparatus. The apparatus may also remain installed on the hoodie after the hoodie is removed from the user's head and rests against the user's upper back (not shown). Due to the connector members, the hoodie remains attached to the frame. The visor members remain between the dual layers of the frame.

Those skilled in the art who have the benefit of this disclosure will appreciate that it may be used as the creative basis for designing devices or methods similar to those disclosed herein, or to design improvements to the invention disclosed herein; such new or improved creations should be recognized as dependent upon the invention disclosed herein, to the extent of such reliance upon this disclosure.

I claim:

1. A visor apparatus for use with an existing fabric head covering of an article of clothing, the visor apparatus comprising:

a. a first visor member and a second visor member;

b. a frame having two opposing ends, an upper surface layer, a lower surface layer, and at least two stop members, with one of each of the stop members being affixed at each end of the frame between the upper surface layer and the lower surface layer of the frame to form a gap along a perimeter of the frame;

c. a plurality of connector members mounted on the upper surface layer of the frame for removably connecting the frame to the fabric head covering as the fabric head covering is draped over the frame; and d. a locking mechanism coupled to and engageable with each visor member;

e. wherein each of the visor members independently pivotably travels along an arc at an arc point at the locking mechanism, with each of the visor members selectively traveling from a retractable position between the upper surface layer and the lower surface layer of the frame to one or more expandable positions over a user's face, wherein each of the first visor member and the second visor member shields and protects the user's face from environmental conditions when in an expanded position; and wherein attaching the frame's upper and lower surface layers and the fabric head covering to the frame form a barrier from environmental conditions.

2. The visor apparatus of claim 1, the frame further comprising a support member and a brace member, with the support member and the brace member each having the upper surface layer and the lower surface layer separable by the gap, with the support member having two opposing arms wherein each arm has an end, with the one of each of the stop members being affixed between the upper surface layer and the lower surface layer of each end at a distal portion of the support member.

3. The visor apparatus of claim 2, the support member being configured as an inverted, substantially U-shaped support member having a horizontal bar, the two opposing arms extending downwardly from an each end of the horizontal bar, and the two stop members, with each of the arms defining a bore for engaging with the locking mechanism as the visor members pivotably travel about the arc point.

4. The visor apparatus of claim 2, the frame further comprising at least two bridges, with each bridge linking a side of the brace member to each respective support member arm, with each bridge having the upper surface layer and the lower surface layer separable by the gap.

5. The visor apparatus of claim 1, the visor apparatus further comprising a cushion adhered under the lower surface layer of the frame for abutting against a user's head when the apparatus is worn with the fabric head covering.

6. The visor apparatus of claim 1, each of the visor members comprising a rim, a lens, and a ventilation means, with the rim configured to support a lens.

7. The visor apparatus of claim 6, the ventilation means comprising a plurality of ventilation holes defined along at least the rim of the visor member.

8. The visor apparatus of claim 6, the lens of each of the visor members comprising a scratch-resistant, photochromic material for aiding against UV rays.

9. A visor apparatus for use with an existing fabric head covering of an article of clothing, the visor apparatus comprising:

a. a first visor member and a second visor member;

b. a frame having an inverted U-shaped support member and a brace member, with the support member and the brace member each comprising an upper surface layer and a lower surface layer separable by a gap therethrough, with the support member further comprising two downwardly extending arms and at least two stop members wherein one of each of the stop members being affixed in the gap between the upper surface layer and the lower surface layer at a distal portion of the support member;

c. a cushion adhered under the lower surface layer of at least the support member of the frame for abutting against a user's head when the apparatus is worn with the fabric head covering;

d. a plurality of connector members, with at least one portion of the connector members being mounted onto the upper surface layer of the support member for removably connecting the support member to the fabric head covering as the fabric head covering is draped over and contours to a shape of the frame; and e. a locking mechanism coupled to and engageable with each visor member;

f. wherein each visor member pivotably travels along an arc at an arc point at the locking mechanism, with both visor members selectively traveling from a retractable position between the upper surface layer and the lower surface layer of the frame, to the first visor member traveling to at least a first expandable position, to the second visor member traveling to at least a second expandable position, wherein each of the first visor member and the second visor member shields and protects a user's face from environmental conditions when in an expanded position;

g. wherein attaching the frame's upper and lower surface layers and the fabric head covering to the frame form a barrier from environmental conditions; and h. wherein the apparatus remains connected to the fabric head covering when the fabric head covering is pushed away from the user's head.

10. The visor apparatus of claim 9, each arm of the support member further defining a bore for engaging with the locking mechanism as each of the first visor member and the second visor member pivotably travels about the arc point.

11. The visor apparatus of claim 9, the frame further comprising at least two bridges, with each bridge linking a side of the brace member to each respective support member arm, with each bridge having the upper surface layer and the lower surface layer separable by the gap.

12. The visor apparatus of claim 9, each of the visor members comprising a rim, a lens, and a ventilation means, with the rim configured to support a lens.

13. The visor apparatus of claim 12, the ventilation means comprising a plurality of ventilation holes defined along at least the rim of each of the visor members.

14. The visor apparatus of claim 13, the ventilation means further comprising a slidable closing mechanism for slidably closing one or more of the plurality of ventilation holes in each of the visor members.

15. The visor apparatus of claim 12, the lens of each of the visor members is scratch-resistant and is made from photochromic material for aiding against UV rays.

16. The visor apparatus of claim 9, each of the plurality of connector members being selected from the group consisting of clips, snaps, pins, and combinations thereof, with at least one portion of the connector members being affixed to the exterior of the support member.

17. A visor apparatus for use with an existing fabric head covering of an article of clothing, the visor apparatus comprising:

a. a substantially rigid first visor member and a substantially rigid second visor member, each of the visor members comprising a rim, a lens, and a ventilation means, with the rim configured to support the lens;

b. a substantially rigid frame having an inverted U-shaped support member, a brace member, and at least two bridges, with the support member, the brace member, and the at least two bridges each comprising an upper surface layer and a lower surface layer separable by a gap therethrough, with the support member further comprising two downwardly extending arms and at least two stop members, wherein one of each of the stop members being affixed in the gap between the upper surface layer and the lower surface layer at a distal portion of the support member arms, and with each bridge linking a side of the brace member to each respective support member arm;

c. a cushion adhered under the lower surface layer of at least the support member of the frame for abutting against a user's head when the apparatus is worn with the fabric head covering;

d. a plurality of connector members, with at least one portion of the connector members being mounted onto the upper surface layer of the support member for removably connecting the support member to the fabric head covering as the fabric head covering is draped over and contours to a shape of the frame; and e. a locking mechanism coupled to and engageable with each visor member;

f. wherein each of the visor members selectively travels along an arc at an arc point at the locking mechanism, with both visor members traveling from a retractable position between the upper surface layer and the lower surface layer of the frame, to the first visor member traveling to at least a first expandable position down to a user's nose, to the second visor member traveling to at least a second expandable position down to at least a user's chin or neck, with the expansion of the second visor member being abuttable against the frame's stop members, wherein each of the first visor member and the second visor member shields and protects a user's face from environmental conditions when in an expanded position;

g. wherein each arm of the support member defining a bore for engaging with the locking mechanism as the visor members pivotably travel about the arc point; and h. wherein attaching the frame's upper and lower surface layers and the fabric head covering to the frame form a barrier from environmental conditions.

18. The visor apparatus of claim 17, the ventilation means comprising a plurality of ventilation holes defined along at least the rim of the visor member.

19. The visor apparatus of claim 17, the lens of each of the visor members comprising a scratch-resistant, photochromic material for aiding against UV rays.

20. The visor apparatus of claim 17, each of the plurality of connector members being selected from the group consisting of clips, snaps, pins, and combinations thereof, with at least one portion of the connector members being affixed to the exterior of the support member.

* * * * *